US005911506A

United States Patent [19]

Nakamura et al.

[11] Patent Number: 5,911,506

[45] Date of Patent: Jun. 15, 1999

[54] CONTROL SYSTEM FOR PRIME MOVER AND HYDRAULIC PUMP OF HYDRAULIC CONSTRUCTION MACHINE

[75] Inventors: Kazunori Nakamura, Ibaraki; Ei Takahashi, Tsuchiura; Tsukasa Toyooka, Ibaraki-ken; Kouji Ishikawa, Ibaraki-ken; Tsuyoshi Nakamura, Ibaraki-ken; Yoichi Kowatari, Ibaraki-ken; Tadatoshi Shimamura, Ishioka; Genroku Sugiyama, Ibaraki-ken; Toichi Hirata, Ushiku, all of Japan

[73] Assignee: Hitachi Construction Machinery Co., Ltd., Tokyo, Japan

[21] Appl. No.: 09/166,848

[22] Filed: Oct. 6, 1998

[30] Foreign Application Priority Data

Oct. 8, 1997 [JP] Japan ..... 9-276102

[51] Int. Cl.[6] ..... E02F 9/20

[52] U.S. Cl. ..... 37/348; 701/50

[58] Field of Search ..... 37/348, 382, 414, 37/415, 416; 701/50; 172/2

[56] References Cited

FOREIGN PATENT DOCUMENTS 62-94622 5/1987 Japan .
3-189405 8/1991 Japan .
7-119506 5/1995 Japan .

*Primary Examiner*—Christopher J. Novosad
*Attorney, Agent, or Firm*—Fay, Sharpe, Beall, Fagan, Minnich & McKee

[57] ABSTRACT

A reference pump-delivery-rate calculating portion calculates a reference delivery rate of a hydraulic pump by referring to a table stored in a memory based on a control pilot pressure for the hydraulic pump. A target pump-delivery-rate calculating portion divides the reference delivery rate by a ratio of a maximum revolution speed to a target engine revolution speed, thereby calculating a target delivery rate. A target pump tilting calculating portion divides the target delivery rate by an actual engine revolution speed and a constant, thereby calculating a target tilting. A solenoid output current calculating portion calculates a drive current to provide the target tilting and outputs the drive current to a solenoid control valve. The pump delivery rate is thereby controlled with good response following input change of an operation instructing device.

6 Claims, 7 Drawing Sheets

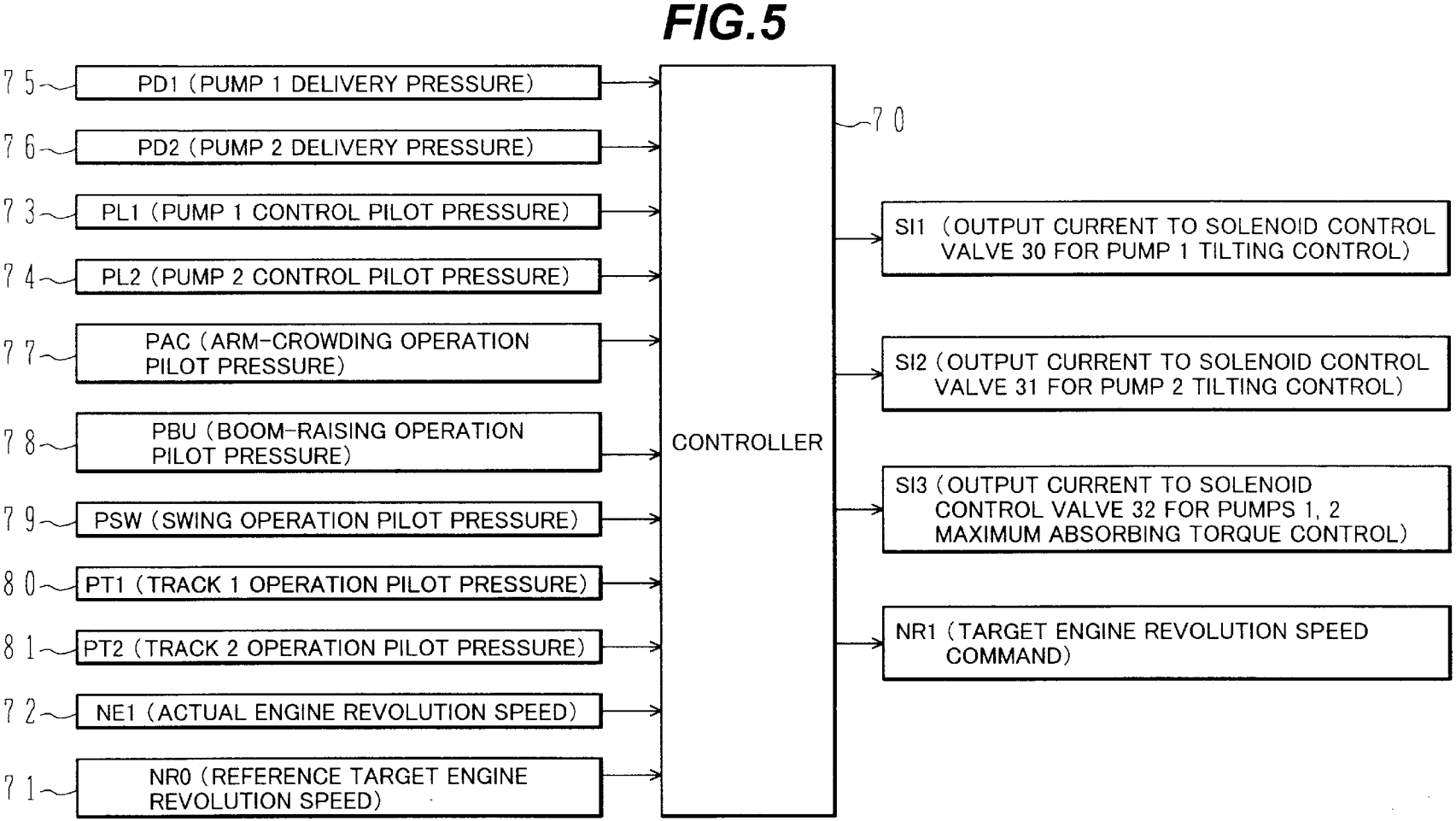
FIG.5
CONTROLLER
70
PD1 (PUMP 1 DELIVERY PRESSURE)
PD2 (PUMP 2 DELIVERY PRESSURE)
PL1 (PUMP 1 CONTROL PILOT PRESSURE)
PL2 (PUMP 2 CONTROL PILOT PRESSURE)
PAC (ARM-CROWDING OPERATION PILOT PRESSURE)
PBU (BOOM-RAISING OPERATION PILOT PRESSURE)
PSW (SWING OPERATION PILOT PRESSURE)
PT1 (TRACK 1 OPERATION PILOT PRESSURE)
PT2 (TRACK 2 OPERATION PILOT PRESSURE)
NE1 (ACTUAL ENGINE REVOLUTION SPEED)
NR0 (REFERENCE TARGET ENGINE REVOLUTION SPEED)
SI1 (OUTPUT CURRENT TO SOLENOID CONTROL VALVE 30 FOR PUMP 1 TILTING CONTROL)
SI2 (OUTPUT CURRENT TO SOLENOID CONTROL VALVE 31 FOR PUMP 2 TILTING CONTROL)
SI3 (OUTPUT CURRENT TO SOLENOID CONTROL VALVE 32 FOR PUMPS 1, 2 MAXIMUM ABSORBING TORQUE CONTROL)
NR1 (TARGET ENGINE REVOLUTION SPEED COMMAND)
75
76
73
74
77
78
79
80
81
72
71

CONTROL SYSTEM FOR PRIME MOVER AND HYDRAULIC PUMP OF HYDRAULIC CONSTRUCTION MACHINE

BACKGROUND OF THE INVENTION

1. Field of the Invention

The present invention relates to a control system for a prime mover and a hydraulic pump of a hydraulic construction machine, and more particularly to a control system for a prime mover and a hydraulic pump of a hydraulic construction machine, such as a hydraulic excavator, wherein hydraulic actuators are operated by a hydraulic fluid delivered from a hydraulic pump, which is driven by an engine for rotation, for carrying out works required.

2. Description of the Prior Art

Generally, in the hydraulic construction machine such as a hydraulic excavator, a diesel engine is provided as a prime mover, at least one variable displacement hydraulic pump is driven by the diesel engine for rotation, and a plurality of hydraulic actuators are operated by a hydraulic fluid delivered from the hydraulic pump for carrying out works required. The diesel engine is provided with input means, such as an accelerator lever, for instructing a target revolution speed. An amount of fuel injected is controlled depending on the target revolution speed, and an engine revolution speed is controlled correspondingly.

In relation to control of the prime mover and the hydraulic pump in such a hydraulic construction machine, there are known several prior arts. For control of the hydraulic pump, JP, A, 3-189405, for example, discloses a positive pump tilting control system wherein a target tilting position of a hydraulic pump is calculated depending on the direction and input amount in and by which control levers or pedals of operation instructing means respectively associated with a plurality of hydraulic actuators are each operated, to thereby control an actual tilting position of the hydraulic pump.

For control of the prime mover, a control system is proposed in JP, A, 7-119506 entitled Revolution Speed Control System for Prime Mover of Hydraulic Construction Machine. In the disclosed control system, a target revolution speed is input, as a reference, by operating a fuel lever, and the direction and input amount in and by which control levers or pedals of operation instructing means respectively associated with a plurality of hydraulic actuators are each operated (hereinafter referred to simply as the lever operating direction and lever input amount), as well as an actuator load (pump delivery pressure) are detected. A modification value of the engine revolution speed is determined based on the lever operating direction, the lever input amount and the actuator load, and the target revolution speed is modified using the revolution speed modification value to thereby control the engine revolution speed. In this control system, when the lever input amount is small and when the actuator load is low, the engine target revolution speed is set to a relatively low value for energy saving. When the lever input amount is large and when the actuator load is high, the engine target revolution speed is set to a relatively high value for increasing working efficiency.

Further, JP, A, 62-94622 discloses a control system which receives a signal of the lever input amount and controls both a prime mover and a hydraulic pump in a linked manner. In the disclosed control system, a hydraulic flow rate necessary for work is calculated from the input amount by which a working mechanism control lever is operated, and at least one of a revolution speed of an engine and a tilting angle of a variable pump driven by the engine is controlled in accordance with a resulting control signal, for thereby improving fuel consumption during the operation under a light load and a low flow rate, and reducing a noise level. Additionally, when an actual engine revolution speed is lower than a target engine revolution speed, the pump tilting is reduced to prevent the engine from stalling.

SUMMARY OF THE INVENTION

The above prior arts have however the problems below.

In the positive pump tilting control system for the hydraulic pump, as disclosed in JP, A, 3-189405, when the control lever or pedal of the operation instructing means is operated, the tilting of the hydraulic pump is increased depending on the lever input amount, causing a pump delivery rate to increase to a value corresponding to the input amount (demanded flow rate). However, a load imposed on the actuator of a hydraulic construction machine, such as a hydraulic excavator, is so large in many cases that when the pump tilting is increased depending on the input amount, an input torque of the hydraulic pump is increased and the engine revolution speed is lowered temporarily less than the target revolution speed. Although the lowering of the engine revolution speed is then compensated for to return to the target revolution speed under governor control of the engine, the pump delivery rate is deviated from a target flow rate corresponding to the lever input amount during the lowering of the engine revolution speed, and reaches the target flow rate only after the engine revolution speed has returned to around the original value. Accordingly, the pump delivery rate is not changed with good response following input change of the lever input amount, and operability is deteriorated.

In the engine control disclosed in JP, A, 7-119506, when the lever input amount of the operation instructing means is changed, the target revolution speed is modified correspondingly and the engine revolution speed is controlled to become coincident with the modified target revolution speed. Supposing the case where the positive tilting control is additionally employed in control of a hydraulic pump of a hydraulic construction machine which includes such a control system for the prime mover, when the lever input amount of the operation instructing means is changed, the target revolution speed would be modified corresponding to the input amount and the engine revolution speed could be controlled likewise. However, because the engine control also includes a response delay due to load, there would occur a condition where the engine revolution speed is lowered temporarily less than the target revolution speed from due processes in both the control of the hydraulic pump and the control of the engine. As a result, a response delay in the engine control upon change of the lever input amount is more remarkable and operability is further deteriorated. Additionally, in this prior art, because the target revolution speed is modified upon change of the actuator load (pump delivery pressure) as well, there occurs such a problem that the pump delivery rate is varied with a response delay in the engine control despite no change of the lever input change.

In the conventional control system disclosed in JP, A, 62-94622, when the actual engine revolution speed is lower than the target engine revolution speed, the pump tilting is reduced to prevent the engine from stalling. This prior art however also has the problem that the pump delivery rate is varied with variations of the engine revolution speed caused by a response delay.

An object of the present invention is to provide a control system for a prime mover and a hydraulic pump, with which when a revolution speed of the prime mover and a tilting of the hydraulic pump are controlled upon input change of operation instructing means, a pump delivery rate can be controlled with good response following the input change of the operation instructing means.

(1) To achieve the above object, according to the present invention, there is provided a control system for a prime mover and a hydraulic pump of a hydraulic construction machine comprising a prime mover, at least one variable displacement hydraulic pump driven by the prime mover, a plurality of hydraulic actuators driven by a hydraulic fluid delivered from the hydraulic pump, operation instructing means for instructing operations of the plurality of hydraulic actuators, and means for setting a target revolution speed of the prime mover, a revolution speed of the prime mover being controlled in accordance with the target revolution speed, a tilting position of the hydraulic pump being controlled in accordance with command signals from the operation instructing means, wherein the control system comprises revolution speed detecting means for detecting an actual revolution speed of the prime mover, and positive pump-delivery-rate control means for calculating a target tilting position of the hydraulic pump corresponding to the command signals from the operation instructing means, and then controlling the tilting position of the hydraulic pump, the positive pump-delivery-rate control means including target tilting position determining means for calculating a target delivery rate of the hydraulic pump corresponding to the command signals, calculating a tilting position, at which the hydraulic pump delivers the target delivery rate, from the target delivery rate and the actual revolution speed of the prime mover detected by the revolution speed detecting means, and then setting the calculated tilting position as the target tilting position.

Thus, the target tilting position determining means calculates the target delivery rate corresponding to the command signals, and then calculates the tilting position, at which the hydraulic pump delivers the target delivery rate, from the target delivery rate and the actual revolution speed of the prime mover. Therefore, when there occurs a deviation between the target revolution speed and the actual revolution speed due to input change of the operation instructing means, the pump delivery rate can be controlled with good response following the input change of the operation instructing means despite a response delay in the revolution speed control of the prime mover.

(2) Also, to achieve the above object, according to the present invention, there is provided a control system for a prime mover and a hydraulic pump of a hydraulic construction machine comprising a prime mover, at least one variable displacement hydraulic pump driven by the prime mover, a plurality of hydraulic actuators driven by a hydraulic fluid delivered from the hydraulic pump, operation instructing means for instructing operations of the plurality of hydraulic actuators, operation detecting means for detecting command signals from the operation instructing means, load detecting means for detecting loads of the plurality of hydraulic actuators, and input means for instructing a reference target revolution speed of the prime mover, a revolution speed of the prime mover being controlled by calculating a modification value of the reference target revolution speed based on values detected by the operation detecting means and the load detecting means, and modifying the reference target revolution speed using the calculated modification value to provide a target revolution speed, wherein the control system comprises revolution speed detecting means for detecting an actual revolution speed of the prime mover, and positive pump-delivery-rate control means for calculating a target tilting position of the hydraulic pump corresponding to the command signals from the operation instructing means, and then controlling the tilting position of the hydraulic pump, the positive pump-delivery-rate control means including target tilting position determining means for calculating a target delivery rate of the hydraulic pump corresponding to the command signals, calculating a tilting position, at which the hydraulic pump delivers the target delivery rate, from the target delivery rate and the actual revolution speed of the prime mover detected by the revolution speed detecting means, and then setting the calculated tilting position as the target tilting position.

With this feature, even when the target revolution speed is changed due to input changes of the operation instructing means and the load detecting means, and the revolution speed control of the prime mover is subject to a response delay, the pump delivery rate can be controlled with good response following the input change of the operation instructing means despite such a response delay.

(3) Further, to achieve the above object, according to the present invention, there is provided a control system for a prime mover and a hydraulic pump of a hydraulic construction machine comprising a prime mover, at least one variable displacement hydraulic pump driven by the prime mover, a plurality of hydraulic actuators driven by a hydraulic fluid delivered from the hydraulic pump, operation instructing means for instructing operations of the plurality of hydraulic actuators, and means for setting a target revolution speed of the prime mover, a revolution speed of the prime mover being controlled in accordance with the target revolution speed, a tilting position of the hydraulic pump being controlled in accordance with command signals from the operation instructing means, wherein the control system comprises revolution speed detecting means for detecting an actual revolution speed of the prime mover, positive pump-delivery-rate control means for calculating a target tilting position of the hydraulic pump corresponding to the command signals from the operation instructing means, and then controlling the tilting position of the hydraulic pump, and maximum absorbing torque control means for calculating a target maximum absorbing torque of the hydraulic pump corresponding to the target revolution speed, and limit-controlling a maximum capacity of the hydraulic pump so that the maximum absorbing torque of the hydraulic pump is held not larger than the target maximum absorbing torque, the positive pump-delivery-rate control means including target tilting position determining means for calculating a target delivery rate of the hydraulic pump corresponding to the command signals, calculating a tilting position, at which the hydraulic pump delivers the target delivery rate, from the target delivery rate and the actual revolution speed of the prime mover detected by the revolution speed detecting means, and then setting the calculated tilting position as the target tilting position.

With this feature, as mentioned in the above (1), when there occurs a deviation between the target revolution speed and the actual revolution speed due to input change of the operation instructing means, the pump delivery rate can be controlled with good response following the input change of the operation instructing means despite a response delay in the revolution speed control of the prime mover. In addition, even when there occurs a deviation between the target revolution speed and the actual revolution speed, the maximum absorbing torque control means makes control so that the maximum absorbing torque of the hydraulic pump is held not larger than the target maximum absorbing torque. Accordingly, the prime mover can be prevented from stalling while the delivery rate of the hydraulic pump can be controlled with good response.

(4) In the above (1)–(3), preferably, the target tilting position determining means calculates the tilting position by dividing the target delivery rate by the actual revolution speed of the prime mover and a preset constant.

With this feature, the tilting position of the hydraulic pump corresponding to the target delivery rate can be quickly achieved.

(5) In the above (1)–(3), preferably, the target tilting position determining means obtains the target delivery rate of the hydraulic pump by calculating a reference delivery rate of the hydraulic pump corresponding to the command signals, and modifying the calculated reference delivery rate in accordance with the target revolution speed of the prime mover.

With this feature that the target tilting position determining means obtains the target delivery rate by modifying the reference delivery rate corresponding to the command signals in accordance with the target revolution speed of the prime mover, the target delivery rate can be increased and decreased in accordance with the target revolution speed of the prime mover.

(6) In the above (5), preferably, the target tilting position determining means obtains the target delivery rate of the hydraulic pump by dividing the reference delivery rate by a ratio of a preset maximum revolution speed to the target engine revolution speed of the prime mover.

With this feature, the target delivery rate can be increased and decreased in accordance with the target revolution speed of the prime mover.

BRIEF DESCRIPTION OF THE DRAWINGS

FIG. 5 is a block diagram showing input/output relations of a controller shown in FIG. 1.

DESCRIPTION OF THE PREFERRED EMBODIMENT

A preferred embodiment of the present invention will be described hereunder with reference to the drawings. In the following embodiment, the present invention is applied to a control system for a prime mover and hydraulic pumps of a hydraulic excavator.

Figure 1:
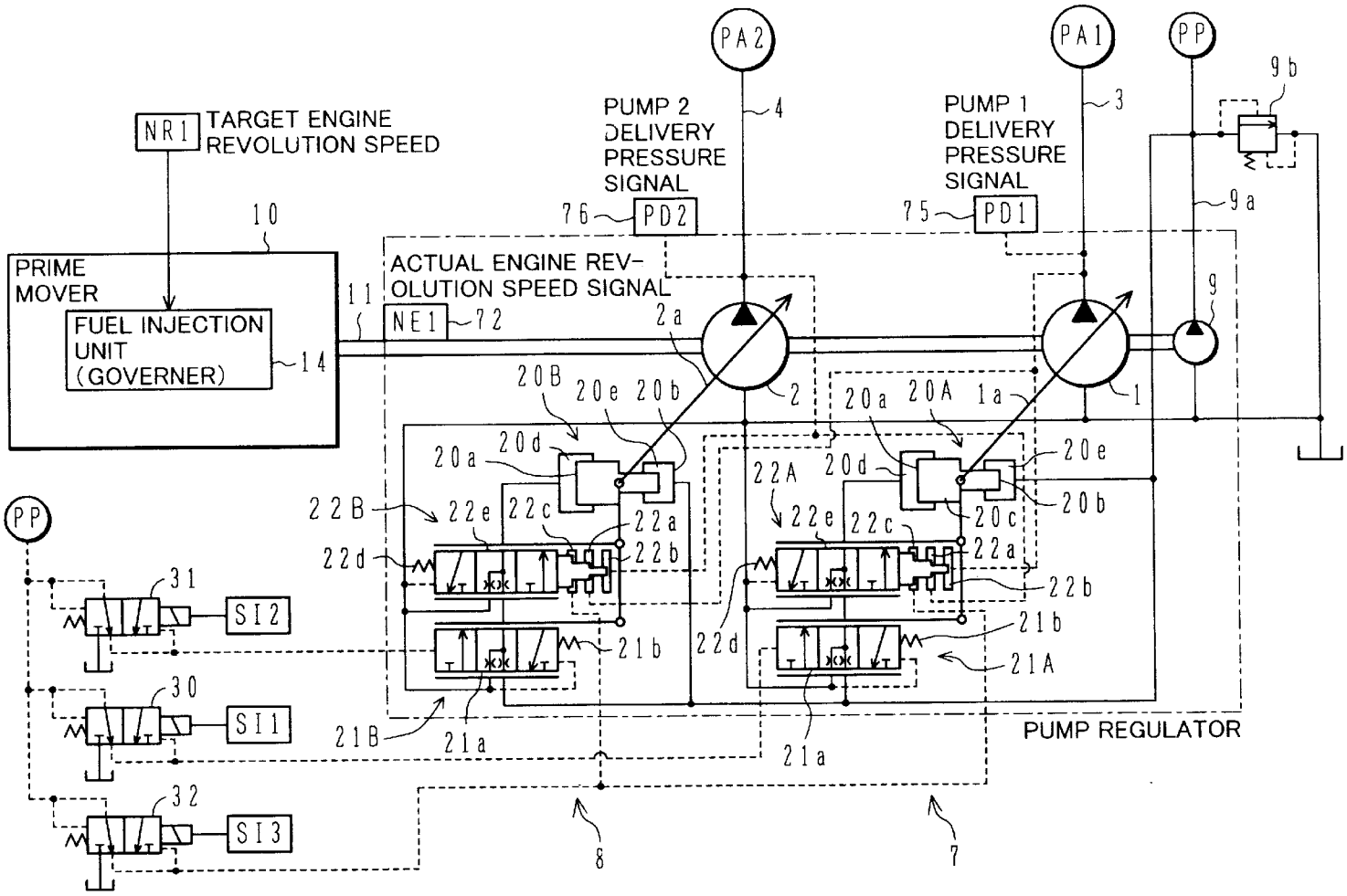
FIG. 1 is a diagram showing a control system for a prime mover and hydraulic pumps according to one embodiment of the present invention.
Figure 2:
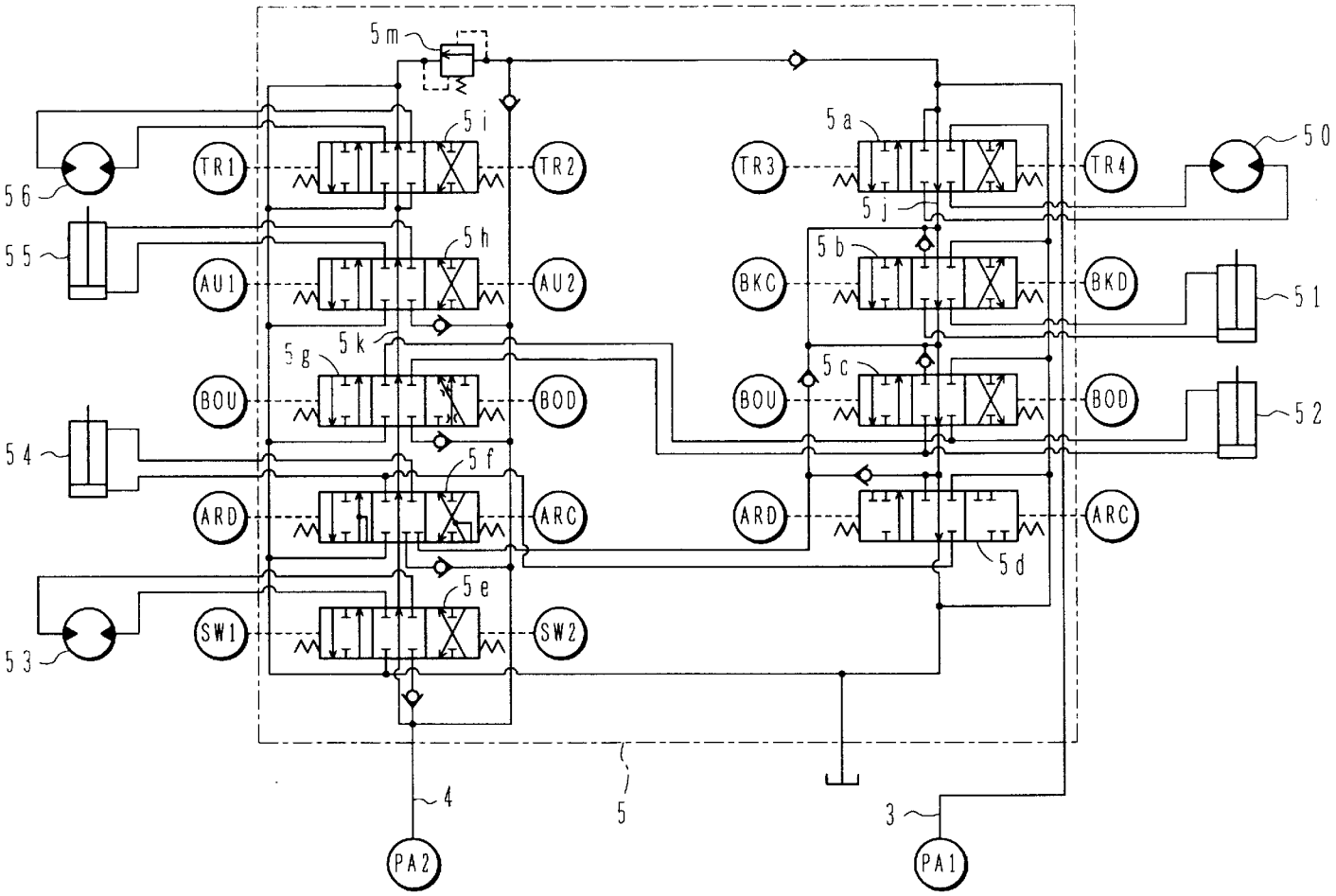
FIG. 2 is a hydraulic circuit diagram of a valve unit and actuators connected to the hydraulic pumps shown in FIG.

In FIG. 1, designated by reference numerals 1 and 2 are variable displacement pumps of swash plate type, for example. A valve unit 5 shown in FIG. 2 is connected to delivery lines 3, 4 of the hydraulic pumps 1, 2, and hydraulic fluids from the hydraulic pumps are delivered to a plurality of actuators 50–56 through the valve unit 5 for operating the actuators.

Denoted by 9 is a fixed displacement pilot pump. A pilot relief valve 9*b* for holding a delivery pressure of the pilot pump 9 at a constant level is connected to a delivery line 9*a* of the pilot pump 9.

The hydraulic pumps 1, 2 and the pilot pump 9 are connected to an output shaft 11 of a prime mover 10 to be driven by the prime mover 10 for rotation.

Details of the valve unit 5 will be described below.

In FIG. 2, the valve unit 5 has two valve groups, i.e., a group of flow control valves 5*a*–5*d* and a group of flow control valves 5*e*–5*i*. The flow control valves 5*a*–5*d* are positioned on a center bypass line 5*j* which is connected to the delivery line 3 of the hydraulic pump 1, and the flow control valves 5*e*–5*i* are positioned on a center bypass line 5*k* which is connected to the delivery line 4 of the hydraulic pump 2. A main relief valve 5*m* for determining a maximum level of the delivery pressures of the hydraulic pumps 1, 2 is disposed in the delivery lines 3, 4.

The flow control valves 5*a*–5*d* and 5*e*–5*i* are center bypass valves. The hydraulic fluids delivered from the hydraulic pumps 1, 2 are supplied to corresponding one or more of the actuators 50–56 through the flow control valves. The actuator 50 is a hydraulic motor for a right track (right track motor), the actuator 51 is a hydraulic cylinder for a bucket (bucket cylinder), the actuator 52 is a hydraulic cylinder for a boom (boom cylinder), the actuator 53 is a hydraulic motor for swing (swing motor), the actuator 54 is a hydraulic cylinder for an arm (arm cylinder), the actuator 55 is a hydraulic cylinder for reserve, and the actuator 56 is a hydraulic motor for a left track (left track motor). The flow control valve 5*a* is for the right track, the flow control valve 5*b* is for the bucket, the flow control valve 5*c* is the first one for the boom, the flow control valve 5*d* is the second one for the arm, the flow control valve 5*e* is for swing, the flow control valve 5*f* is the first one for the arm, the flow control valve 5*g* is the second one for the boom, the flow control valve 5*h* is for reserve, and the flow control valve 5*i* is for the left track. In other words, the two flow control valves 5*g*, 5*c* are provided for the boom cylinder 52 and the two flow control valves 5*d*, 5*f* are provided for the arm cylinder 54 so that the hydraulic fluids from the two hydraulic pumps 1, 2 are joined together and supplied to the bottom side of each of the boom cylinder 52 and the arm cylinder 54.

Figure 3:
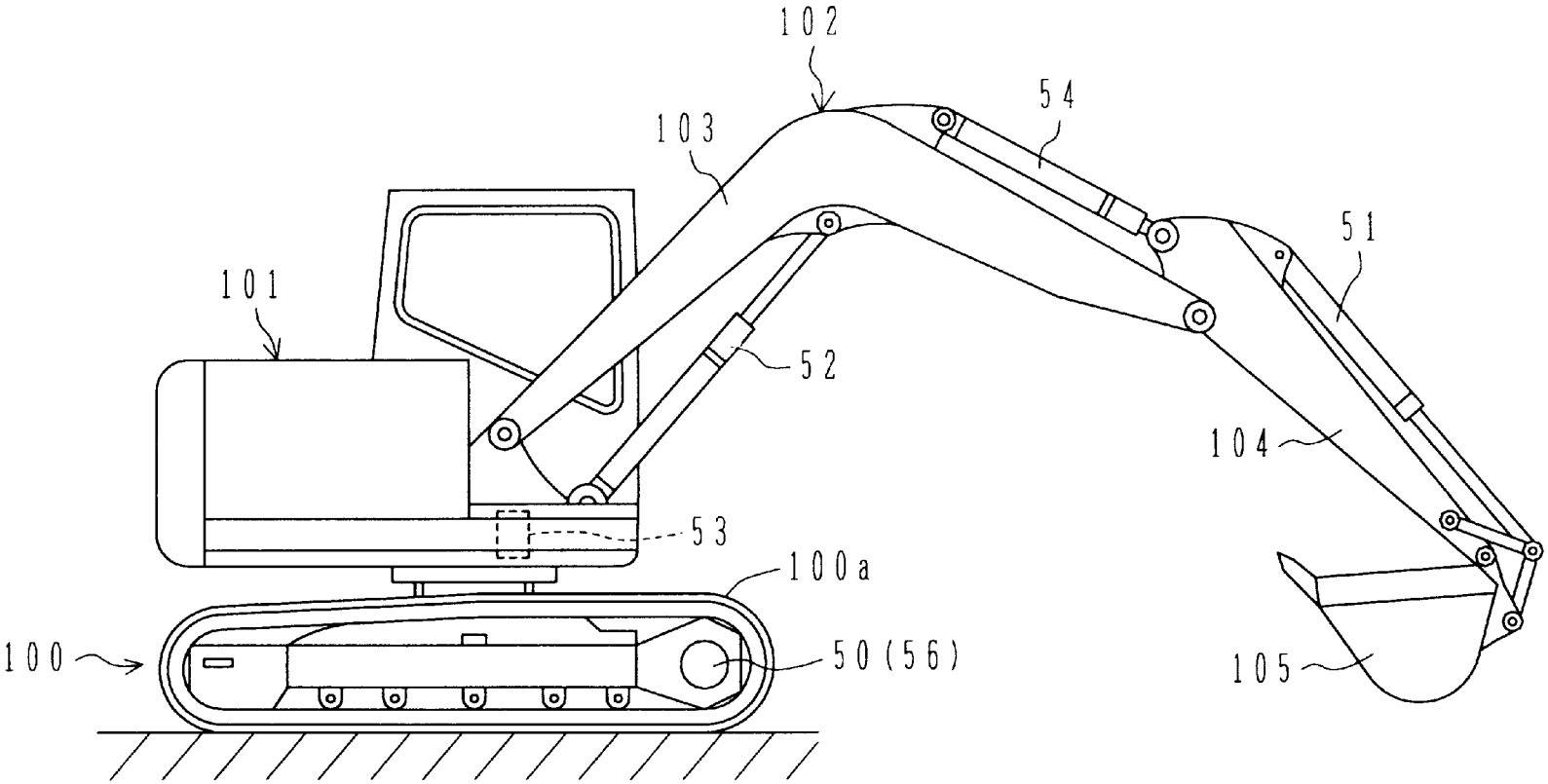
FIG. 3 is a side view showing an appearance of a hydraulic excavator in which the control system for the prime mover and hydraulic pumps, according to the present invention, is installed.

FIG. 3 shows an appearance of a hydraulic excavator in which the control system for the prime mover and the hydraulic pumps, according to the present invention, is installed. The hydraulic excavator is made up of a lower track structure 100, an upper swing structure 101, and a front operating mechanism 102. The right and left track motors 50, 56 are mounted on the lower track structure 100 to drive respective crawlers 100*a* for rotation, whereupon the excavator travels forward or rearward. The swing motor 53 is mounted on the upper swing structure 101 to swing the upper swing structure 101 clockwise or counterclockwise with respect to the lower track structure 100. The front operating mechanism 102 is made up of a boom 103, an arm 104 and a bucket 105. The boom 103 is vertically rotated by the boom cylinder 52, the arm 104 is operated by the arm cylinder 54 to rotate toward the dumping (unfolding) side or the crowding (scooping) side, and the bucket 105 is operated by the bucket cylinder 51 to rotate toward the dumping (unfolding) side or the crowding (scooping) side.

Figure 4:
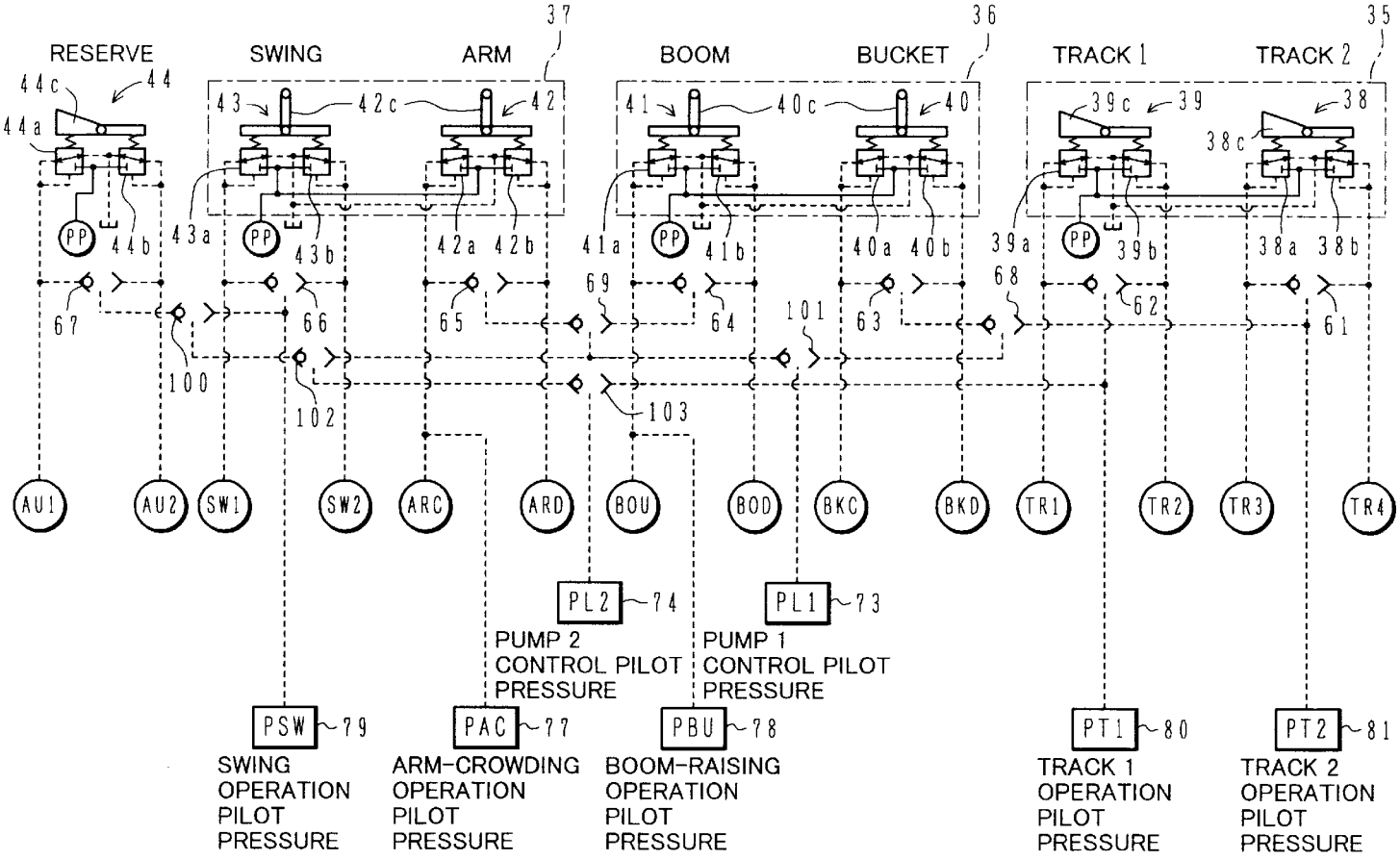
FIG. 4 is a diagram showing an operation pilot system for flow control valves shown in FIG. 2.

FIG. 4 shows an operation pilot system for the flow control valves 5*a*–5*i*.

The flow control valves 5*i*, 5*a* are shifted by operation pilot pressures TR1, TR2; TR3, TR4 from operation pilot devices 39, 38 of an operating unit 35, respectively. The flow control valve 5*b* and the flow control valves 5*c*, 5*g* are shifted by operation pilot pressures BKC, BKD; BOD, BOU from operation pilot devices 40, 41 of an operating unit 36, respectively. The flow control valves 5*d*, 5*f* and the flow control valves 5*e* are shifted by operation pilot pressures ARC, ARD; SW1, SW2 from operation pilot devices 42, 43 of an operating unit 37, respectively. The flow control valve 5*h* is shifted by operation pilot pressures AU1, AU2 from an operating pilot device 44.

The operation pilot devices 38–44 comprise respectively pairs of pilot valves (pressure reducing valves) 38*a*, 38*b*–44*a*, 44*b*. The operation pilot devices 38, 39, 44 further comprise respectively control pedals 38*c*, 39*c*, 44*c*. The operation pilot devices 40, 41 further comprise a common control lever 40*c*, and the operation pilot devices 42, 43 further comprise a common control lever 42*c*. When any of the control pedals 38*c*, 39*c*, 44*c* and the control levers 40*c*, 42*c* is operated, one of the pilot valves of the associated operation pilot device is shifted depending on the direction in which the control pedal or lever is operated, and an operation pilot pressure is generated depending on the input amount by which the control pedal or lever is operated.

Shuttle valves 61–67 are connected to output lines of the respective pilot valves of the operation pilot devices 38–44. Other shuttle valves 68–69 and 120–123 are further connected to the shuttle valves 61–67 in a hierarchical structure. The shuttle valves 61, 63, 64, 65, 68, 69 and 101 cooperatively detect the maximum of the operation pilot pressures from the operation pilot devices 38, 40, 41 and 42 as a control pilot pressure PL1 for the hydraulic pump 1. The shuttle valves 62, 64, 65, 66, 67, 69, 102 and 103 cooperatively detect the maximum of the operation pilot pressures from the operation pilot devices 39, 41, 42, 43 and 44 as a control pilot pressure PL2 for the hydraulic pump 2.

Further, the shuttle valve 61 detects the higher of the operation pilot pressures from the operation pilot device 38 as a pilot pressure for operating the track motor 56 (hereinafter referred to as a track 2 operation pilot pressure PT2). The shuttle valve 62 detects the higher of the operation pilot pressures from the operation pilot device 39 as a pilot pressure for operating the track motor 50 (hereinafter referred to as a track 1 operation pilot pressure PT1). The shuttle valve 66 detects the higher of the operation pilot pressures from the operation pilot device 43 as a pilot pressure PWS for operating the swing motor 53 (hereinafter referred to as a swing operation pilot pressure).

The control system for the prime mover and the hydraulic pumps according to the present invention is installed in the hydraulic drive system described above. Details of the control system will be described below.

Returning to FIG. 1, the hydraulic pumps 1, 2 are provided with regulators 7, 8 for controlling tilting positions of swash plates 1*a*, 2*a* of capacity varying mechanisms for the hydraulic pumps 1, 2, respectively.

The regulators 7, 8 of the hydraulic pumps 1, 2 comprise, respectively, tilting actuators 20A, 20B (hereinafter represented simply by 20), first servo valves 21A, 21B (hereinafter represented simply by 21) for positive tilting control based on the operation pilot pressures from the operation pilot devices 38–44 shown in FIG. 4, and second servo valves 22A, 22B (hereinafter represented simply by 22) for total horsepower control of the hydraulic pumps 1, 2. These servo valves 21, 22 control the pressure of a hydraulic fluid delivered from the pilot pump 9 and acting on the tilting actuators 20, thereby controlling the tilting positions of the hydraulic pumps 1, 2.

Details of the tilting actuators 20 and the first and second serve valves 21, 22 will now be described.

The tilting actuators 20 each comprise an operating piston 20*c* provided with a large-diameter pressure bearing portion 20*a* and a small-diameter pressure bearing portion 20*b* at opposite ends thereof, and pressure bearing chambers 20*d*, 20*e* in which the pressure bearing portions 20*a*, 20*b* are positioned respectively. When pressures in both the pressure bearing chambers 20*d*, 20*e* are equal to each other, the operating piston 20*c* is moved to the right on the drawing, whereupon the tilting of the swash plate 1*a* or 2*a* is diminished to reduce the pump delivery rate. When the pressure in the large-diameter pressure bearing chamber 20*d* lowers, the operating piston 20*c* is moved to the left on the drawing, whereupon the tilting of the swash plate 1*a* or 2*a* is enlarged to increase the pump delivery rate. Further, the large-diameter pressure bearing chamber 20*d* is connected to a delivery line 9*a* of the pilot pump 9 through the first and second servo valves 21, 22, whereas the small-diameter pressure bearing chamber 20*e* is directly connected to the delivery line 9*a* of the pilot pump 9.

The first servo valves 21 for positive tilting control are each a valve operated by a control pressure from a solenoid control valve 30 or 31 for controlling the tilting position of the hydraulic pump 1 or 2. When the control pressure is high, a valve body 21*a* is moved to the right on the drawing, causing the pilot pressure from the pilot pump 9 to be transmitted to the pressure bearing chamber 20*d* without being reduced, whereby the tilting of the hydraulic pump 1 or 2 is reduced. As the control pressure lowers, the valve body 21*a* is moved to the left on the drawing by the force of a spring 21*b*, causing the pilot pressure from the pilot pump 9 to be transmitted to the pressure bearing chamber 20*d* after being reduced, whereby the tilting of the hydraulic pump 1 or 2 is increased.

The second servo valves 22 for total horsepower control are each a valve operated by the delivery pressures of the hydraulic pumps 1, 2 and a control pressure from a solenoid control valve 32, thereby effecting the total horsepower control for the hydraulic pumps 1, 2. A maximum absorbing torque of the hydraulic pumps 1, 2 is limit-controlled in accordance with the control pressure from the solenoid control valve 32.

More specifically, the delivery pressures of the hydraulic pumps 1, 2 and the control pressure from the solenoid control valve 32 are introduced respectively to pressure bearing chambers 22*a*, 22*b*, 22*c* in an operation drive sector of the second servo valve 22. When the sum of hydraulic pressure forces given by the delivery pressures of the hydraulic pumps 1 and 2 is lower than a setting value which is determined by a difference between the resilient force of a spring 22*d* and hydraulic pressure force given by the control pressure introduced to the pressure bearing chamber 22*c*, a valve body 22*e* is moved to the right on the drawing, causing the pilot pressure from the pilot pump 9 to be transmitted to the pressure bearing chamber 20*d* after being reduced, whereby the tilting of the hydraulic pump 1 or 2 is increased. As the sum of hydraulic pressure forces given by the delivery pressures of the hydraulic pumps 1 and 2 rises over the setting value, the valve body 22*e* is moved to the left on the drawing, causing the pilot pressure from the pilot pump 9 to be transmitted to the pressure bearing chamber 20*d* without being reduced, whereby the tilting of the hydraulic pump 1 or 2 is reduced. Further, when the control pressure from the solenoid control valve 32 is low, the setting value is increased so that the tilting of the hydraulic pump 1 or 2 starts reducing from a relatively high delivery pressure of the hydraulic pump 1 or 2, and as the control pressure from the solenoid control valve 32 rises, the setting value is decreased so that the tilting of the hydraulic pump 1 or 2 starts reducing from a relatively low delivery pressure of the hydraulic pump 1 or 2.

The solenoid control valves 30, 31, 32 are proportional pressure reducing valves operated by drive currents SI1, SI2, SI3, respectively, such that the control pressures output from them are maximized when the drive currents SI1, SI2, SI3 are minimum, and are lowered as the drive currents SI1, SI2, SI3 increase. The drive currents SI1, SI2, SI3 are output from a controller 70 shown in FIG. 5.

The prime mover 10 is a diesel engine and includes a fuel injection unit 14. The fuel injection unit 14 has a governor mechanism and controls the engine revolution speed to become coincident with a target engine revolution speed NR1 based on an output signal from the controller 70 shown in FIG. 5.

There are several types of governor mechanisms for use in the fuel injection unit, e.g., an electronic governor control unit for effecting control to achieve the target engine revolution speed directly based on an electric signal from the controller, and a mechanical governor control unit in which a motor is coupled to a governor lever of a fuel injection pump and a position of the governor lever is controlled by driving the motor in accordance with a command value from the controller so that the governor lever takes a predetermined position at which the target engine revolution speed is achieved. The fuel injection unit 14 in this embodiment may be any suitable type.

The prime mover 10 is provided with a target engine-revolution-speed input unit 71 through which the operator manually enters a reference target engine revolution speed NR0, as shown in FIG. 5. An input signal of the reference target engine revolution speed NR0 is taken into the controller 70. The target engine-revolution-speed input unit 71 may comprise electric input means, such as a potentiometer, for directly entering the signal to the controller 70, thus enabling the operator to select the magnitude of the target engine revolution speed as a reference. The reference target engine revolution speed NR0 is generally set to be large for heavy excavation work and small for light works.

As shown in FIG. 1, there are provided a revolution speed sensor 72 for detecting an actual revolution speed NE1 of the prime mover 10, and pressure sensors 75, 76 for detecting delivery pressures PD1, PD2 of the hydraulic pumps 1, 2. Further, as shown in FIG. 4, there are provided pressure sensors 73, 74 for detecting the control pilot pressures PL1, PL2 for the hydraulic pumps 1, 2, a pressure sensor 77 for detecting an arm-crowding operation pilot pressure PAC, a pressure sensor 78 for detecting an boom-raising operation pilot pressure PBU, a pressure sensor 79 for detecting the swing operation pilot pressure PWS, a pressure sensor 80 for detecting the track 1 operation pilot pressure PT1, and a pressure sensor 81 for detecting the track 2 operation pilot pressure PT2.

FIG. 5 shows input/output relations of all signals to and from the controller 70. The controller 70 receives the signal of the reference target engine revolution speed NR0 from the target engine-revolution-speed input unit 71, a signal of the actual revolution speed NE1 from the revolution speed sensor 72, signals of the pump control pilot pressures PL1, PL2 from the pressure sensors 73, 74, signals of the delivery pressures PD1, PD2 of the hydraulic pumps 1, 2 from the pressure sensors 75, 76, as well as signals of the arm-crowding operation pilot pressure PAC, the boom-raising operation pilot pressure PBU, the swing operation pilot pressure PWS, the track 1 operation pilot pressure PT1, and the track 2 operation pilot pressure PT2 from the pressure sensors 77–81. After executing predetermined arithmetic operations, the controller 70 outputs the drive currents SI1, SI2, SI3 to the solenoid control valves 30–32, respectively, for controlling the tilting positions, i.e., the delivery rates, of the hydraulic pumps 1, 2, and also outputs a signal of the target engine revolution speed NR1 to the fuel injection unit 14 for controlling the engine revolution speed.

Figure 6:
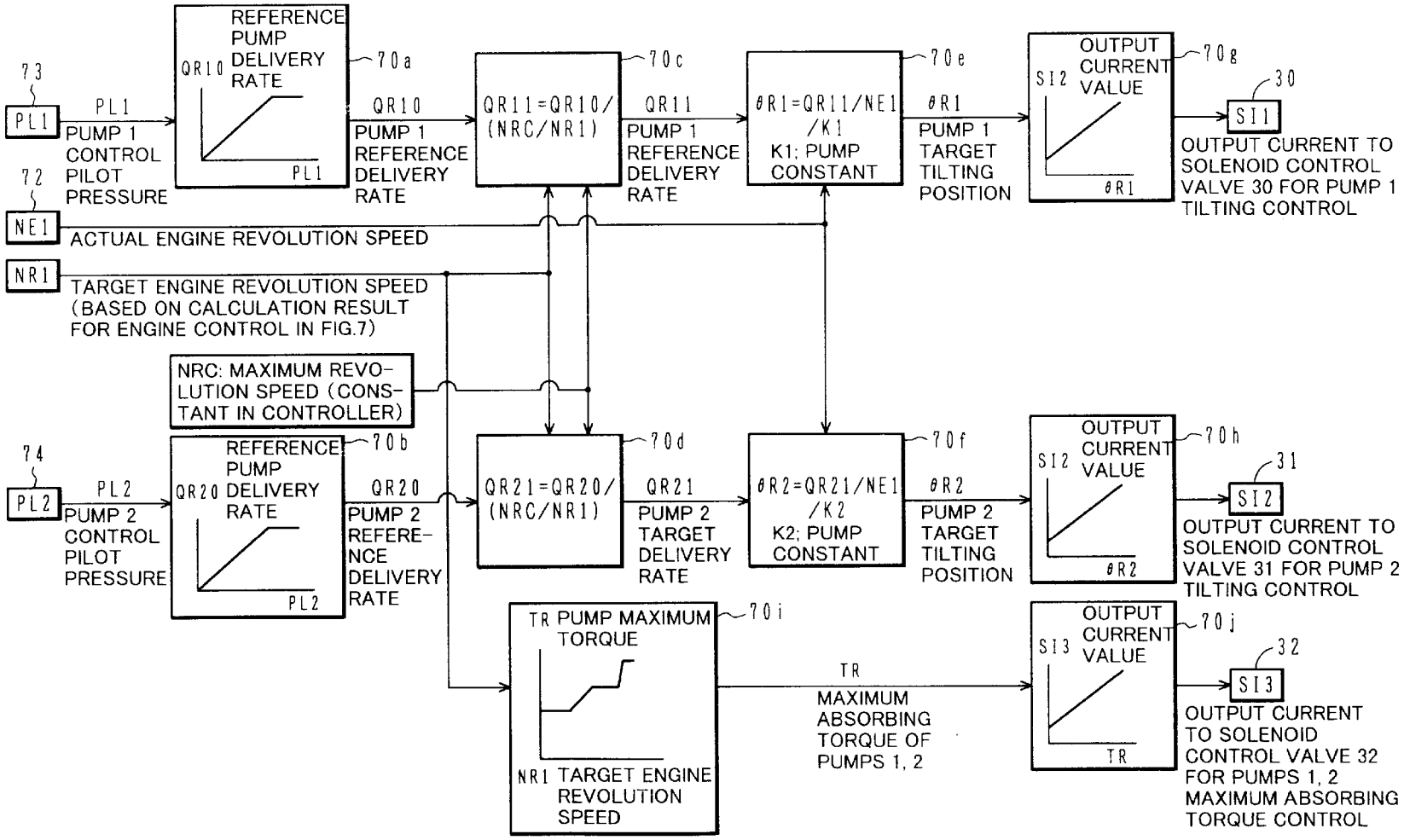
FIG. 6 is a functional block diagram showing processing functions executed in a pump control section of the controller.

FIG. 6 shows processing functions executed by the controller 70 for control of the hydraulic pumps 1, 2.

In FIG. 6, the controller 70 has functions of reference pump-delivery-rate calculating portions 70*a*, 70*b*, target pump-delivery-rate calculating portions 70*c*, 70*d*, target pump tilting calculating portions 70*e*, 70*f*, solenoid output current calculating portions 70*g*, 70*h*, a pump maximum absorbing torque calculating portion 70*i*, and a solenoid output current calculating portion 70*j*.

The reference pump-delivery-rate calculating portion 70*a* receives the signal of the control pilot pressure PL1 for the hydraulic pump 1, and calculates a reference delivery rate QR10 of the hydraulic pump 1 corresponding to the control pilot pressure PL1 at that time by referring to an PL1–QR10 table stored in a memory. The reference delivery rate QR10 is used as a reference flow metering value for positive tilting control in accordance with the input amounts from the operation pilot devices 38, 40, 41 and 42. In the memory table, a relationship between PL1 and QR10 is set such that the reference delivery rate QR10 is increased as the control pilot pressure PL1 rises.

The target pump-delivery-rate calculating portion 70*c* receives a signal of a target engine revolution speed NR1 (described later), and divides the reference delivery rate QR10 by a ratio (NRC/NR1) of a maximum revolution speed NRC, which is stored in a memory beforehand, to the target engine revolution speed NR1, thereby calculating a target delivery rate QR11 of the hydraulic pump 1. The purpose of this calculation is to modify the pump delivery rate in consideration of the target engine revolution speed entered according to the operators intention, and to calculate the target delivery rate modified depending on the target engine revolution speed NR1. In other words, when the target engine revolution speed NR1 is set to a large value, this means that a large pump delivery rate is also desired, and therefore the target delivery rate QR11 is increased correspondingly. When the target engine revolution speed NR1 is set to a small value, this means that a small pump delivery rate is also desired, and therefore the target delivery rate QR11 is decreased correspondingly.

The target pump tilting calculating portion 70*e* receives the signal of the actual engine revolution speed NE1, and divides the target delivery rate QR11 by the actual engine revolution speed NE1, followed by further dividing the quotient by a constant K1 which is stored in a memory beforehand, to thereby calculate a target tilting θR1 of the hydraulic pump 1. The purpose of this calculation is that even if the actual engine revolution speed does not become NR1 immediately due to a response delay in the engine control upon change of the target engine revolution speed NR1, the target delivery rate QR11 can be obtained at once without a response delay by using the target tilting θR1 resulted from dividing the target delivery rate QR11 by the actual engine revolution speed NE1.

The solenoid output current calculating portion 70*g* calculates the drive current S11 for use in the tilting control of the hydraulic pump 1 to provide the target tilting θR1, and then outputs the drive current S11 to the solenoid control valve 30.

The reference pump-delivery-rate calculating portion 70*b*, the target pump-delivery-rate calculating portion 70*d*, the target pump tilting calculating portion 70*f*, and the solenoid output current calculating portion 70*h* cooperatively calculate the drive current S12 for use in the tilting control of the hydraulic pump 2 from the pump control signal L2, the target engine revolution speed NR1 and the actual engine revolution speed NE1 likewise, followed by outputting the drive current S12 to the solenoid control valve 31.

The pump maximum absorbing torque calculating portion 70*i* receives the signal of the target engine revolution speed NR1 and calculates a maximum absorbing torque TR of the hydraulic pumps 1, 2 corresponding to the target engine revolution speed NR1 at that time by referring to an NR1—TR table stored in a memory. The maximum absorbing torque TR is an absorbing torque of the hydraulic pumps 1, 2 in match with an output torque characteristic of the engine 10 rotating at the target engine revolution speed NR1. In the memory table, a relationship between NR1 and TR is set such that the pump maximum absorbing torque TR is increased as the target engine revolution speed NR1 rises.

The solenoid output current calculating portion 70*j* calculates the drive current SI3 of the solenoid control valve 32 for use in maximum absorbing torque control of the hydraulic pumps 1, 2 to provide the pump maximum absorbing torque TR, and outputs the drive current SI3 to the solenoid control valve 32.

Figure 7:
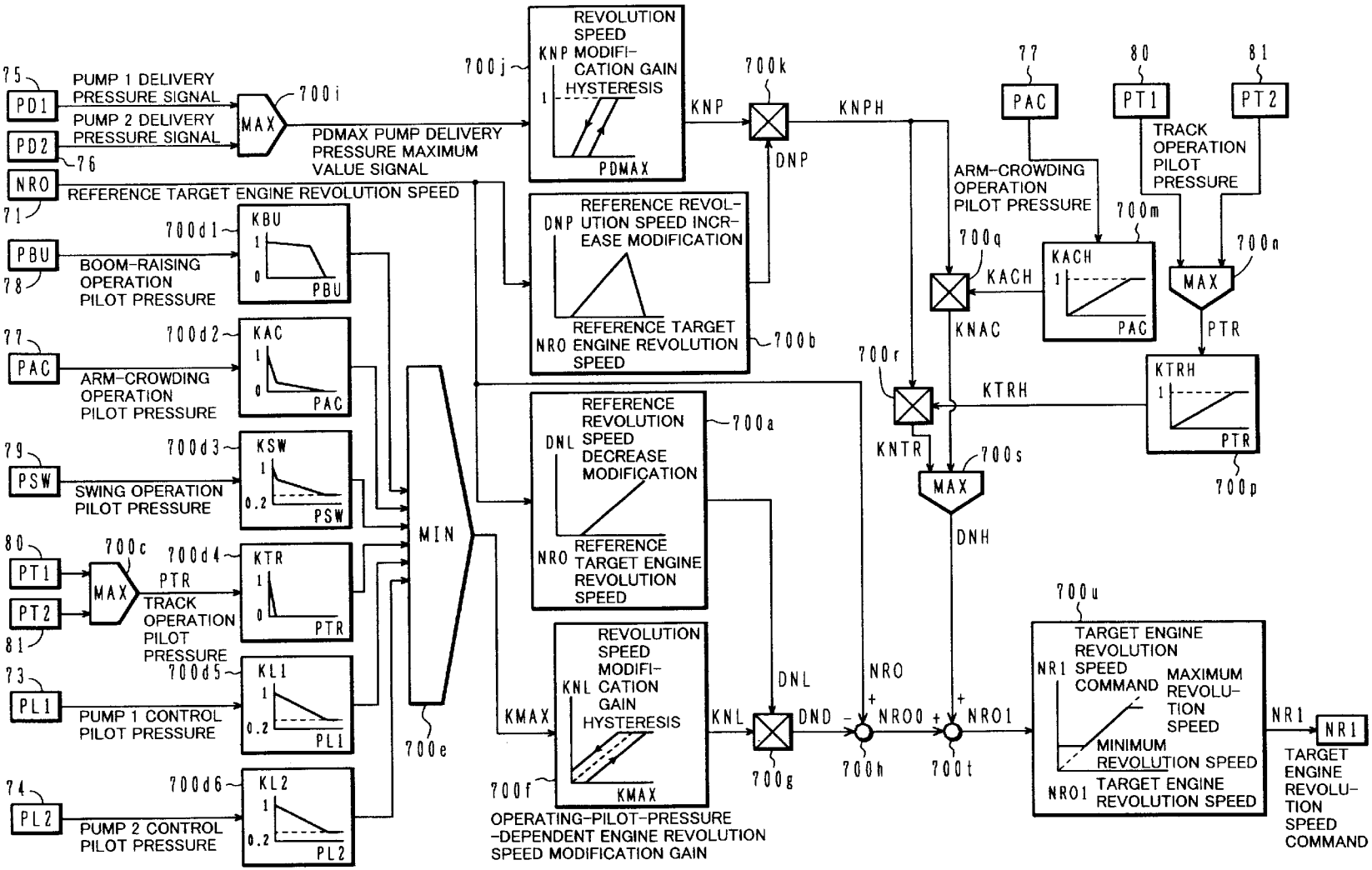
FIG. 7 is a functional block diagram showing processing functions executed in an engine control section of the controller.

FIG. 7 shows processing functions executed by the controller 70 for control of the engine 10.

In FIG. 7, the controller 70 has functions of a reference-revolution-speed decrease modification calculating portion 700*a*, a reference-revolution-speed increase modification calculating portion 700*b*, a maximum value selecting portion 700*c*, engine-revolution-speed modification gain calculating portions 700*d*1–700*d*6, a minimum value selecting portion 700*e*, a hysteresis calculating portion 700*f*, an operation-pilot-pressure-dependent engine revolution speed modification calculating portion 700*g*, a first reference target-engine-revolution-speed modifying portion 700*h*, a maximum value selecting portion 700*i*, a hysteresis calculating portion 700*j*, a pump-delivery-pressure signal modifying portion 700*k*, a modification gain calculating portion 700*m*, a maximum value selecting portion 700*n*, a modification gain calculating portion 700*p*, a first pump-delivery-pressure-dependent engine-revolution-speed modification calculating portion 700*q*, a second pump-delivery-pressure-dependent engine-revolution-speed modification calculating portion 700*r*, a maximum value selecting portion 700*s*, a second reference target-engine-revolution-speed modifying portion 700*t*, and a limiter calculating portion 700*u*.

The reference-revolution-speed decrease modification calculating portion 700*a* receives the signal of the reference target engine revolution speed NR0 from the target engine-revolution-speed input unit 71, and calculates a reference-revolution-speed decrease modification DNL corresponding to the NR0 at that time by referring to an NR0—DNL table stored in a memory. The DNL serves as a reference width of the engine revolution speed modification in accordance with changes of the inputs from the control levers or pedals of the operation pilot devices 38–44 (i.e., change in any operation pilot pressure). Because the revolution speed modification is desired to become smaller as the target engine revolution speed decreases, the memory table stores a relationship between NR0 and DNL set such that the reference-revolution-speed decrease modification DNL is reduced as the reference target engine revolution speed NR0 decreases.

Similarly to the calculating portion 700*a*, the reference-revolution-speed increase modification calculating portion 700*b* receives the signal of the reference target engine revolution speed NR0 and calculates a reference-revolution-speed increase modification DNP corresponding to the NR0 at that time by referring to an NR0—DNP table stored in a memory. The DNP serves as a reference width of the engine revolution speed modification in accordance with input change of the pump delivery pressure. Because the revolution speed modification is desired to become smaller as the target engine revolution speed decreases, the memory table stores a relationship between NR0 and DNP set such that the reference-revolution-speed increase modification DNP is reduced as the reference target engine revolution speed NR0 decreases. Incidentally, the engine revolution speed cannot be increased over a specific maximum revolution speed. The increase modification DNP is therefore reduced near a maximum value of the reference target engine revolution speed NR0.

The maximum value selecting portion 700*c* selects the higher of the track 1 operation pilot pressure PT1 and the track 2 operation pilot pressure PT2, and outputs it as a track operation pilot pressure PTR.

The engine-revolution-speed modification gain calculating portions 700*d*1–700*d*6 receive the signals of the boom-raising operation pilot pressure PBU, the arm-crowding operation pilot pressure PAC, the swing operation pilot pressure PWS, the track operation pilot pressure PTR and the pump control pilot pressures PL1, PL2, and calculate engine-revolution-speed modification gains KBU, KAC, KSW, KTR, KL1 and KL2 corresponding to the received operation pilot pressures at that time by referring to respective tables stored in memories. These modification gains are each used for calculating a revolution speed modification component (an engine-revolution-speed decrease modification DND) which is subtracted from the reference target engine revolution speed NR0 (as described later). A resulting target revolution speed is reduced as the modification gain increases. Also, it is required that the target revolution speed be increased with an increase of the pilot pressure. Accordingly, all the modification gains KBU, KAC, KSW, KTR, KL1 and KL2 are set to a maximum value 1 when the pilot pressure is 0.

The calculating portions 700*d*1–700*d*4 each serve to preset change of the engine revolution speed with respect to change of the input from the control lever or pedal (i.e., change of the operation pilot pressure) associated with the actuator to be operated correspondingly, for the purpose of facilitating the operation. The engine-revolution-speed modification gains KBU, KAC, KSW, KTR, KL1 and KL2 are set as follows.

The boom-raising operation is employed in many cases in a fine operating range as required for position alignment in lifting and leveling works. In the fine operating range of the boom-raising operation, therefore, the engine revolution speed is reduced and the gain slope is made small.

When the arm-crowding operation is employed in excavation work, the control lever is operated to a full stroke in many cases. To reduce variations of the revolution speed near the full lever stroke, therefore, the gain slope is made small near the full lever stroke.

For the swing operation, to reduce variations of the revolution speed in an intermediate range, the gain slope in the intermediate range is made small.

In the track operation, since powerful propulsion is required from a fine operating range, the engine revolution speed is set to a relatively high value from the fine operating range.

The engine revolution speed at the full lever stroke is also variable for each of the actuators. For example, in the boom-raising and arm-crowding operations which require a large flow rate, the engine revolution speed is set to a relatively high value. In other operations, the engine revolution speed is set to a relatively low value. In the track operation, the engine revolution speed is set to a relatively high value to increase the traveling speed of the excavator.

The memory tables in the calculating portions 700*d*1–700*d*4 store relationships between the operation pilot pressures and the modification gains KBU, KAC, KSW and KTR set corresponding to the above conditions.

More specifically, the memory table in the calculating portion 700*d*1 stores a relationship between PBU and KBU set such that when the boom-raising operation pilot pressure PBU is in a low range, the modification gain KBU is increased toward 1 at a small slope as the pilot pressure PBU lowers, and when the pilot pressure PBU is raised to a value near the maximum level, the modification gain KBU becomes 0.

The memory table in the calculating portion 700*d*2 stores a relationship between PAC and KAC set such that when the arm-crowding operation pilot pressure PAC is in a high range, the modification gain KAC is decreased toward 0 at a small slope as the pilot pressure PAC rises.

The memory table in the calculating portion 700*d*3 stores a relationship between PSW and KSW set such that when the swing operation pilot pressure PSW is in a range near an intermediate pressure, the modification gain KSW is decreased toward 0.2 at a small slope as the pilot pressure PSW rises.

The memory table in the calculating portion 700*d*4 stores a relationship between PTR and KTR set such that when the track operation pilot pressure PTR is in a fine operating range or higher range, the modification gain KTR is 0.

Further, the pump control pilot pressures PL1, PL2 input to the calculating portions 700*d*5, 700*d*6 are given as the maximums of the associated operation pilot pressures. The engine-revolution-speed modification gains KL1, KL2 are calculated from the pump control pilot pressures PL1, PL2 which are each representative of all the associated operation pilot pressures.

It is generally desired that the engine revolution speed be increased as the operation pilot pressure (input amount from the control lever or pedal) rises. The memory tables in the calculating portions 700*d*5, 700*d*6 store relationships between the pump control pilot pressures PL1, PL2 and the modification gains KL1, KL2 set in consideration of such a desire. Also, the minimum value selecting portion 700*e* selects a minimum value with reference given to the calculating portions 700*d*1–700*d*4. To this end, the modification gains KL1, KL2 are set to a value somewhat larger than 0, i.e., 0.2, in ranges near maximum levels of the pump control pilot pressures PL1, PL2.

The minimum value selecting portion 700*e* selects the minimum of the modification gains calculated by the calculating portions 700*d*1–700*d*6, and then outputs it as KMAX. Here, in the operation other than the boom-raising, arm-crowding, swing and track operations, the engine-revolution-speed modification gains KL1, KL2 are calculated from the pump control pilot pressures PL1, PL2 as representative values and are then selected as KMAX.

The hysteresis calculating portion 700*f* gives a hysteresis to the KMAX, and an obtained result is output as an engine-revolution-speed modification gain KNL depending on the operation pilot pressure.

The operation-pilot-pressure-dependent engine revolution speed modification calculating portion 700*g* multiples the engine-revolution-speed modification gain KNL by the reference-revolution-speed decrease modification DNL mentioned above, thus calculating an engine-revolution-speed decrease modification DND in accordance with input change of the operation pilot pressure.

The first reference target-engine-revolution-speed modifying portion 700*h* subtracts the engine-revolution-speed decrease modification DND from the reference target engine revolution speed NR0, thereby providing a target revolution speed NR00. The target revolution speed NR00 is a target engine revolution speed after being modified depending on the operation pilot pressure.

The maximum value selecting portion 700*i* receives the signals of the delivery pressures PD1, PD2 of the hydraulic pumps 1, 2 and selects the higher of the delivery pressures PD1, PD2, thereby providing it as a pump delivery pressure maximum value signal PDMAX.

The hysteresis calculating portion 700*j* gives a hysteresis to the pump delivery pressure maximum value signal PDMAX, and an obtained result is output as an engine-revolution-speed modification gain KNP depending on the pump delivery pressure.

The pump-delivery-pressure signal modifying portion 700*k* multiples the revolution-speed-modification gain KNP by the reference-revolution-speed increase modification DNP mentioned above, thus calculating an engine revolution basic modification KNPH depending on the pump delivery pressure.

The modification gain calculating portion 700*m* receives the signal of the arm-crowding operation pilot pressure PAC and calculates an engine-revolution-speed modification gain KACH corresponding to the operation pilot pressure PAC at that time by referring to a PAC—KACH table stored in a memory. Because a larger flow rate is required as an input amount for the arm-crowding operation increases, the memory table stores a relationship between PAC and KACH set such that the modification gain KACH is increased as the arm-crowding operation pilot pressure PAC rises.

Similarly to the maximum value selecting portion 700*c*, the maximum value selecting portion 700*n* selects the higher of the track 1 operation pilot pressure PT1 and the track 2 operation pilot pressure PT2, and outputs it as a track operation pilot pressure PTR.

The modification gain calculating portion 700*p* receives a signal of the track operation pilot pressure PTR and calculates an engine-revolution-speed modification gain KTRH corresponding to the operation pilot pressure PTR at that time by referring to a PTR—KTRH table stored in a memory. Also in this case, because a larger flow rate is required as an input amount for the track operation increases, the memory table stores a relationship between PTR and KTRH set such that the modification gain KTRH is increased as the track operation pilot pressure PTR rises.

The first and second pump-delivery-pressure-dependent engine-revolution-speed modification calculating portions 700*q*, 700*r* multiply the pump-delivery-pressure-dependent engine revolution basic modification KNPH by the modification gains KACH, KTRH, thus calculating engine-revolution-speed modifications KNAC, KNTR, respectively.

The maximum value selecting portion 700*s* selects the larger of the engine-revolution-speed modifications KNAC, KNTR and outputs it as a modification DNH. This modification DNH represents an engine-revolution-speed increase modification in accordance with input changes of the pump delivery pressure and the operation pilot pressure.

The above-mentioned process, in which the engine revolution basic modification KNPH is multiplied by the modification gain KACH or KTRH to calculate the engine-revolution-speed modification KNAC or KNTR in the calculating portion 700*q* or 700*r*, means that the engine revolution speed is modified to increase depending on the pump delivery pressure only in the arm-crowding and track operations. Thus, only in the arm-crowding and track operations where the engine revolution speed is desired to become higher as the actuator load increases, the engine revolution speed can be increased with a rise of the pump delivery pressure.

The second reference target-engine-revolution-speed modifying portion 700*t* adds the engine revolution speed increase modification DNH to the aforesaid target revolution speed NR00, thereby calculating a target engine revolution speed NR01.

The limiter calculating portion 700*u* imposes limits on the target engine revolution speed NR01 in accordance with maximum and minimum revolution speeds specific to the engine, thereby calculating a target engine revolution speed NR1 which is sent to the fuel injection unit 14 (see FIG. 1). The target engine revolution speed NR1 is also sent to the pump maximum absorbing torque calculating portion 70*e* (see FIG. 6) provided in the controller 70 for control of the hydraulic pumps 1, 2.

In the above description, the operation pilot devices 38–44 constitute operation instructing means for instructing the operation of the plurality of hydraulic actuators 50–56. The target engine-revolution-speed input unit 71, the pressure sensors 73–81, and the calculating portions 700*a*–700*u* constitute means for setting the target revolution speed of the prime mover 10. The revolution speed of the prime mover 10 is controlled based on the target revolution speed set using that means, and the tilting positions of the hydraulic pumps 1, 2 are controlled in accordance with command signals from the operation instructing means.

Also, the pressure sensors 73, 74 and 77–81 constitute operation detecting means for detecting the command signals from the operation instructing means, and the pressure sensors 75, 76 constitute load detecting means for detecting loads of the plurality of hydraulic actuators 75, 76. The target engine-revolution-speed input unit 71 constitutes input means for instructing the reference target revolution speed of the prime mover 10. The modification value of the reference target revolution speed is calculated based on values detected by the operation detecting means and the load detecting means. The reference target revolution speed is modified using the calculated modification value to provide the target revolution speed, thereby controlling the revolution speed of the prime mover.

Further, the revolution speed sensor 72 constitutes revolution speed detecting means for detecting the actual revolution speed of the prime mover. The reference pump-delivery-rate calculating portions 70*a*, 70*b*, the target pump-delivery-rate calculating portions 70*c*, 70*d*, the target pump tilting calculating portions 70*e*, 70*f*, the solenoid output current calculating portions 70*g*, 70*h*, the solenoid control valves 30, 31, and the first servo valves 21A, 21B constitute positive pump-delivery-rate control means for calculating the target tilting positions of the hydraulic pumps 1, 2 in accordance with the command signals from the operation instructing means, and then controlling the tilting positions of the hydraulic pumps 1, 2. Of the above components, the reference pump-delivery-rate calculating portions 70*a*, 70*b*, the target pump-delivery-rate calculating portions 70*c*, 70*d*, the target pump tilting calculating portions 70*e*, 70*f*, and the solenoid output current calculating portions 70*g*, 70*h* constitute target tilting position determining means for calculating the reference delivery rates of the hydraulic pumps corresponding to the command signals, modifying the calculated reference delivery rates in accordance with the target revolution speed of the prime mover to obtain the target delivery rates of the hydraulic pumps, calculating the tilting positions, at which the hydraulic pumps deliver the target delivery rates, from the target delivery rates and the actual revolution speed of the prime mover detected by the revolution speed detecting means, and then setting the calculated tilting positions as the target tilting positions.

The pump maximum absorbing torque calculating portion 70*i*, the solenoid output current calculating portion 70*j*, the solenoid control valve 32, and the second servo valves 22A, 22B constitute maximum absorbing torque control means for calculating the target maximum absorbing torque of the hydraulic pumps 1, 2 corresponding to the target revolution speed, and limit-controlling the maximum capacity of the hydraulic pumps so that the maximum absorbing torque of the hydraulic pumps is held not larger than the target maximum absorbing torque.

This embodiment constructed as described above can provide advantages below.

(1) In the pump control section shown in FIG. 6, when the target delivery rates QR11, QR21 of the hydraulic pumps 1, 2 calculated by the reference pump-delivery-rate calculating portions 70*a*, 70*b* and the target pump-delivery-rate calculating portions 70*c*, 70*d* are varied upon changes of the control pilot pressures PL1, PL2 for the hydraulic pumps 1, 2 that are caused by change of the operation pilot pressure, the target pump tilting calculating portions 70*e*, 70*f* calculate the target tiltings θR1, θR2 by dividing the target delivery rates QR11, QR21 by the actual engine revolution speed NE1, respectively. Therefore, the delivery rates of the hydraulic pumps 1, 2 are given corresponding to the target delivery rates QR11, QR21. In addition, even if there is a response delay in control of the engine revolution speed when the actual engine revolution speed NE1 of the engine 10 is deviated from the target engine revolution speed NR1, the delivery rates of the hydraulic pumps 1, 2 can be controlled with good response following change of the operation pilot pressure (changes of the target delivery rates QR11, QR21), and superior operability is achieved.

(2) Particularly, in this embodiment, the engine control section shown in FIG. 7 is constructed such that the target engine revolution speed NR1 is modified using the revolution speed decrease modification DND upon change of the operation pilot pressure, and the target engine revolution speed NR1 is modified using the revolution speed increase modification DNH upon change of the pump delivery pressure in the arm-crowding and track operations, whereby the energy saving effect and satisfactory operability can be achieved (described later in more detail). Hitherto, in the case of modifying the target engine revolution speed NR1 upon changes of the operation pilot pressure and the pump delivery pressure, there occurs such a problem that a response delay in the engine control upon change of the operation pilot pressure has become more remarkable, or that the target revolution speed has been changed due to change of the pump delivery pressure despite no change of the operation pilot pressure. In this embodiment, even when a revolution deviation occurs upon change of the target revolution speed, the delivery rates of the hydraulic pumps 1, 2 can be controlled with good response following change of the operation pilot pressure (changes of the target delivery rates QR11, QR21) without being affected by a response delay in control of the engine revolution speed.

(3) The reference delivery rates QR10, QR20 calculated by the reference pump-delivery-rate calculating portions 70*a*, 70*b* are not directly used as the target delivery rates, but converted in the target pump-delivery-rate calculating portions 70*c*, 70*d* into the target delivery rates QR11, QR21 corresponding to the target engine revolution speed NR1. Therefore, reference flow metering values given by the reference delivery rates QR10, QR20 can be modified as modification of the pump delivery rates depending on the target engine revolution speed NR1 entered according to the operator=s intention. Thus, when the operator sets the target engine revolution speed NR1 to a small value with intent to carry out the fine operation, a small pump delivery rate is resulted. When the operator sets the target engine revolution speed NR1 to a large value, a large pump delivery rate is resulted. Additionally, in either case, a metering characteristic can be achieved over an entire range of the lever input amount.

(4) Further, in this embodiment, even when there occurs a deviation between the target engine revolution speed NR1 and the actual engine revolution speed NE1, the pump maximum absorbing torque calculating portion 70*i* calculates the target pump maximum absorbing torque, and the solenoid output current calculating portion 70*j*, the solenoid control valve 32 and the second servo valves 22A, 22B make control so that the maximum absorbing torque of the hydraulic pumps 1, 2 is held not larger than the target maximum absorbing torque. Accordingly, the engine 10 can be prevented from stalling while the delivery rates of the hydraulic pumps 1, 2 can be controlled with good response as mentioned in the above (1) and (2).

(5) On the other hand, the engine control section shown in FIG. 7 is constructed as follows. In the arm-crowding and track operations, the engine-revolution-speed modification gain calculating portion 700*g* calculates the engine-revolution-speed decrease modification DND depending on the operation pilot pressure, while the calculating portions 700*q*, 700*r* and the maximum value selecting portion 700*s* cooperatively calculate the engine-revolution-speed increase modification DNH depending on the pump delivery pressure resulted from modifying the engine-revolution-speed modification gain KNP depending on the pump delivery pressure based on the modification gain KACH or KTRH depending on the operation pilot pressure. The reference target engine revolution speed NR0 is then modified using the engine-revolution-speed decrease modification DND and the engine-revolution-speed increase modification DNH, whereby the engine revolution speed is controlled under modification. Therefore, the engine revolution speed is increased with not only an increase of the input amount from the control lever or pedal, but also a rise of the pump delivery pressure. It is hence possible to achieve powerful excavation work with the arm-crowding operation, and high-speed or powerful traveling with the track operation.

On the other hand, in other operations than the arm-crowding and track operations, the modification gain KACH or KTRH is 0 and the reference target engine revolution speed NR0 is modified using only the engine-revolution-speed decrease modification DND depending on the operation pilot pressure, to thereby control the engine revolution speed. For example, during the boom-raising operation where the pump delivery pressure is greatly changed depending on the posture of the front operating mechanism, therefore, the engine revolution speed is not changed despite variations of the pump delivery pressure, and satisfactory operability can be achieved. Additionally, when the input amount from the control lever or pedal is small, the engine revolution speed is reduced and a great energy saving effect is resulted.

(6) When the operator sets the reference target engine revolution speed NR0 to be low, the reference-revolution-speed decrease modification calculating portion 700*a* and the reference-revolution-speed increase modification calculating portion 700*b* calculate respectively the reference-revolution-speed decrease modification DNL and the reference-revolution-speed increase modification DNP as small values, and the modifications DND, DNH for the reference target engine revolution speed NR0 become also small. In such works as leveling and lifting where the operator carries out the operation using a low range of the engine revolution speed, therefore, the modification width of the target engine revolution speed is reduced automatically, enabling the operator to perform fine works more easily.

(7) The modification gain calculating portions 700*d*1–700*d*4 each preset, as a modification gain, change of the engine revolution speed with respect to change of the input from the control lever or pedal (i.e., change of the operation pilot pressure) associated with the actuator to be operated correspondingly. Satisfactory operability is therefore achieved depending on the characteristics of the individual actuators.

In the calculating portion 700*d*1 for the boom-raising operation, for example, since the slope of the modification gain KBU is set to be small in the fine operating range, change of the engine-revolution-speed decrease modification DND is reduced in the fine operating range. Accordingly, the operator can more easily perform works which are to be effected in the fine operating range of the boom-raising operation, such as position alignment in lifting and leveling works.

In the calculating portion 700*d*2 for the arm-crowding operation, since the slope of the modification gain KAC is set to be small near the full lever stroke, change of the engine-revolution-speed decrease modification DND is reduced near the full lever stroke. Accordingly, excavation work can be performed by the arm-crowding operation with reduced variations of the engine revolution speed near the full lever stroke.

In the calculating portion 700*d*3 for the swing operation, since the slope of the modification gain is set to be small in the intermediate range of the engine revolution speed, the swing operation can be performed with reduced variations of the engine revolution speed in the intermediate range.

In the calculating portion 700*d*4 for the track operation, since the modification gain KTR is set to be small in a wide range including the fine operating range, the engine revolution speed can be increased from the fine track operation, and hence powerful traveling is achieved.

Further, the engine revolution speed at the full lever stroke is also variable for each of the actuators. In the calculating portions 700*d*1, 700*d*2 for the boom-raising and arm-crowding operations, for example, since the modification gains KBU, KAC are set to 0 at the full lever stroke, the engine revolution speed becomes relatively high and the delivery rates of the hydraulic pumps 1, 2 are increased. It is thus possible to lift a heavy load by the boom-raising operation and to perform powerful excavation work by the arm-crowding operation. Also, in the calculating portion 700*d*4 for the swing operation, since the modification gain KTR is set to 0 at the full lever stroke, the engine revolution speed becomes relatively high likewise and the traveling speed of the excavator can be increased. In other operations, since the modification gain is set to a value larger than 0 at the full lever stroke, the engine revolution speed becomes relatively low and the energy saving effect can be achieved.

(8) In other operations than mentioned above, the engine revolution speed is modified using, as representative values, the modification gains PL1, PL2 calculated by the calculating portions 700*d*5, 700*d*6.

(9) When the engine revolution speed is controlled as described above, the engine revolution speed is varied upon change of the operation pilot pressure or the pump delivery pressure. In the pump maximum absorbing torque calculating portion 70*e* shown in FIG. 6, the pump maximum absorbing torque TR is calculated as a function of the modified target engine revolution speed NR1, thereby controlling the maximum absorbing torque of the hydraulic pumps 1, 2. Consequently, the engine output can be effectively utilized despite variations of the engine revolution speed.

In the foregoing embodiment, the present invention is applied to the control system for modifying the target revolution speed of the prime mover depending on input changes of the operation instructing means and the load detecting means. However, similar advantages as stated above can also be achieved when the present invention is applied to the case of setting the target revolution speed of the prime mover 10 using the target engine-revolution-speed input unit 71 alone. This is because, in such a case, when the engine revolution speed is deviated from the target revolution speed due to the actuator load upon change of the tilting of the hydraulic pump, the pump delivery rate is also varied with a response delay in a governor mechanism for controlling the engine revolution speed to be held at the target revolution speed.

According to the present invention, as described above, even when the output of the prime mover is lowered due to change of the environment, it is possible to suppress a decrease of the revolution speed of the prime mover under a high load, and to ensure satisfactory working efficiency. Also, since the speed sensing control is performed as conventionally, the prime mover can be prevented from stalling in the event a abrupt load is applied, or the output of the prime mover is lowered accidentally.

Further, with the speed sensing control, there is no need of setting the absorbing torque of the hydraulic pump beforehand with a sufficient allowing; hence the output of the prime mover can be effectively utilized as conventionally. Even when the output of the prime mover is lowered due to, e.g., variations or time-dependent change of equipment performance, it is possible to prevent the prime mover from stalling under a high load.

What is claimed is:

1. A control system for a prime mover and a hydraulic pump of a hydraulic construction machine comprising the prime mover, at least one variable displacement hydraulic pump driven by said prime mover, a plurality of hydraulic actuators driven by a hydraulic fluid delivered from said hydraulic pump, operation instructing means for instructing operations of said plurality of hydraulic actuators, and means for setting a target revolution speed of said prime mover, a revolution speed of said prime mover being controlled in accordance with the target revolution speed, a tilting position of said hydraulic pump being controlled in accordance with command signals from said operation instructing means, wherein said control system comprises:

revolution speed detecting means for detecting an actual revolution speed of said prime mover, and positive pump-delivery-rate control means for calculating a target tilting position of said hydraulic pump corresponding to the command signals from said operation instructing means, and then controlling the tilting position of said hydraulic pump, said positive pump-delivery-rate control means including target tilting position determining means for calculating a target delivery rate of said hydraulic pump corresponding to the command signals, calculating a tilting position, at which said hydraulic pump delivers the target delivery rate, from the target delivery rate and the actual revolution speed of said prime mover detected by said revolution speed detecting means, and then setting the calculated tilting position as the target tilting position.

2. The control system for a prime mover and a hydraulic pump according to claim 1, wherein said target tilting position determining means calculates the tilting position by dividing the target delivery rate by the actual revolution speed of said prime mover and a preset constant.

3. The control system for a prime mover and a hydraulic pump according to claim 1, wherein said target tilting position determining means obtains the target delivery rate of said hydraulic pump by calculating a reference delivery rate of said hydraulic pump corresponding to the command signals, and modifying the calculated reference delivery rate in accordance with the target revolution speed of said prime mover.

4. The control system for a prime mover and a hydraulic ump according to claim 3, wherein said target tilting position determining means obtains the target delivery rate of said hydraulic pump by dividing the reference delivery rate by a ratio of a preset maximum revolution speed to the target engine revolution speed of said prime mover.

5. A control system for a prime mover and a hydraulic pump of a hydraulic construction machine comprising the prime mover, at least one variable displacement hydraulic pump driven by said prime mover, a plurality of hydraulic actuators driven by a hydraulic fluid delivered from said hydraulic pump, operation instructing means for instructing operations of said plurality of hydraulic actuators, operation detecting means for detecting command signals from said operation instructing means, load detecting means for detecting loads of said plurality of hydraulic actuators, and input means for instructing a reference target revolution speed of said prime mover, a revolution speed of said prime mover being controlled by calculating a modification value of the reference target revolution speed based on values detected by said operation detecting means and said load detecting means, and modifying the reference target revolution speed using the calculated modification value to provide a target revolution speed, wherein said control system comprises:

revolution speed detecting means for detecting an actual revolution speed of said prime mover, and positive pump-delivery-rate control means for calculating a target tilting position of said hydraulic pump corresponding to the command signals from said operation instructing means, and then controlling a tilting position of said hydraulic pump, said positive pump-delivery-rate control means including target tilting position determining means for calculating a target delivery rate of said hydraulic pump corresponding to the command signals, calculating the tilting position, at which said hydraulic pump delivers the target delivery rate, from the target delivery rate and the actual revolution speed of said prime mover detected by said revolution speed detecting means, and then setting the calculated tilting position as the target tilting position.

6. A control system for a prime mover and a hydraulic pump of a hydraulic construction machine comprising the prime mover, at least one variable displacement hydraulic pump driven by said prime mover, a plurality of hydraulic actuators driven by a hydraulic fluid delivered from said hydraulic pump, operation instructing means for instructing operations of said plurality of hydraulic actuators, and means for setting a target revolution speed of said prime mover, a revolution speed of said prime mover being controlled in accordance with the target revolution speed, a tilting position of said hydraulic pump being controlled in accordance with command signals from said operation instructing means, wherein said control system comprises:

revolution speed detecting means for detecting an actual revolution speed of said prime mover, positive pump-delivery-rate control means for calculating a target tilting position of said hydraulic pump corresponding to the command signals from said operation instructing means, and then controlling the tilting position of said hydraulic pump, and maximum absorbing torque control means for calculating a target maximum absorbing torque of said hydraulic pump corresponding to the target revolution speed, and limit-controlling a maximum capacity of said hydraulic pump so that a maximum absorbing torque of said hydraulic pump is held not larger than the target maximum absorbing torque, said positive pump-delivery-rate control means including target tilting position determining means for calculating a target delivery rate of said hydraulic pump corresponding to the command signals, calculating a tilting position, at which said hydraulic pump delivers the target delivery rate, from the target delivery rate and the actual revolution speed of said prime mover detected by said revolution speed detecting means, and then setting the calculated tilting position as the target tilting position.

* * * * *